US006052860A

United States Patent [19]

Coxsey

[11] Patent Number: 6,052,860

[45] Date of Patent: Apr. 25, 2000

[54] LOBBY DUST PAN

[75] Inventor: Joe Bryant Coxsey, Poway, Calif.

[73] Assignee: Arcoa Industries, Inc., San Marcos, Calif.

[21] Appl. No.: 09/148,886

[22] Filed: Sep. 8, 1998

[51] Int. Cl.[7] ..... A47L 13/52

[52] U.S. Cl. ..... 15/257.2; 15/257.1; 15/257.9; 141/316; 141/391; 248/99; 294/1.1; 294/1.4; 383/12; 383/33; 383/111

[58] Field of Search ..... 15/104.8, 257.1–257.9; 141/313, 314, 316, 390, 391; 248/95, 97, 99; 294/1.1, 1.4, 55; 383/12, 33, 111

[56] References Cited

U.S. PATENT DOCUMENTS

| | | | |
|---|---|---|---|
| 926,927 | 7/1909 | Devol | 15/257.2 |
| 2,710,196 | 6/1955 | Larson | 383/12 X |
| 3,017,653 | 1/1962 | Bird | 294/1.1 X |
| 3,747,653 | 7/1973 | Ringer | 15/257.1 X |
| 4,006,928 | 2/1977 | Beugin | 15/257.1 X |
| 4,048,691 | 9/1977 | Spangler | 15/257.1 |
| 5,050,920 | 9/1991 | Potticary | 15/257.1 X |
| 5,222,536 | 6/1993 | Hodgdon et al. | 141/390 |

*Primary Examiner*—Mark Spisich
*Attorney, Agent, or Firm*—John J. Murphey

[57] ABSTRACT

A novel lobby dust pan for receipt of floor sweepings including a light-weight tube having a first downwardly directed portion for carrying by a handle located thereabove; a second portion, spaced-apart from the handle, bending away from the first portion; and, a third portion bending away from the second portion and terminating at near floor level, a frame, formed by interconnecting frame sides, located opposite the third tube portion, attached to the tube and defining an opening projecting forward and above floor level; and, a non-rigid container, having an opening attached about the frame and extending rearward to incase the second and the third tube portions therein, for receipt of dust and debris swept from the floor through the frame opening where the second and the third tube portions provide interior support for the container.

18 Claims, 3 Drawing Sheets

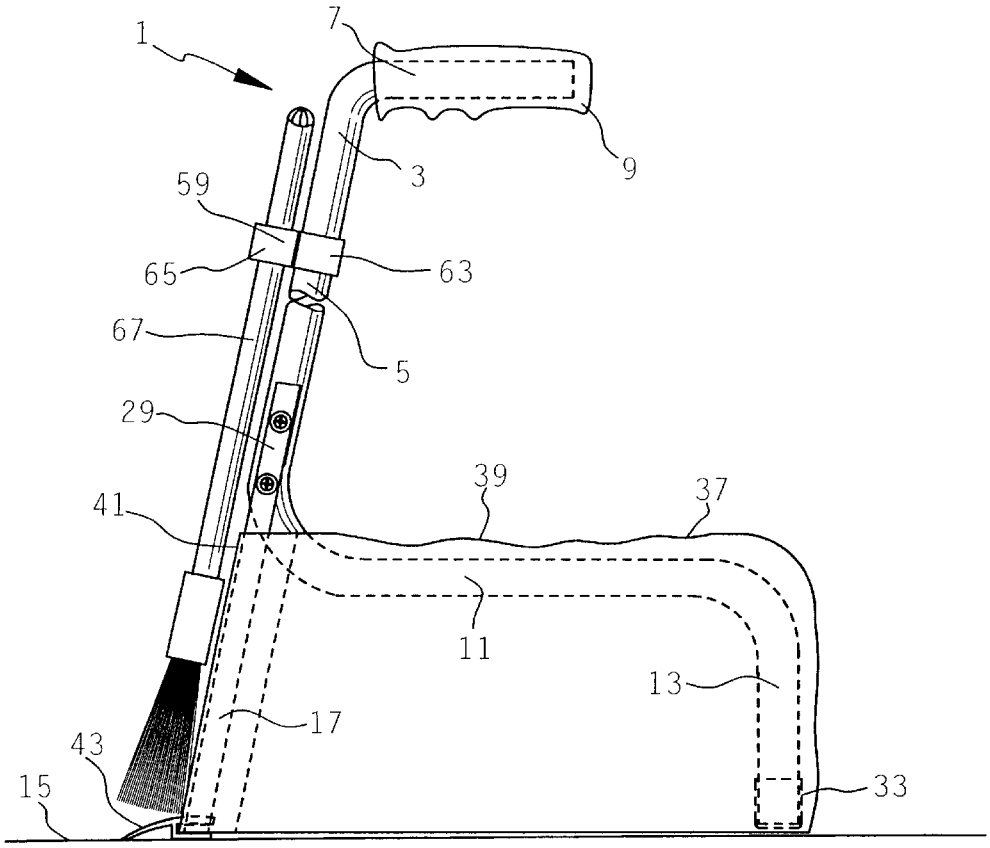
FIG 1
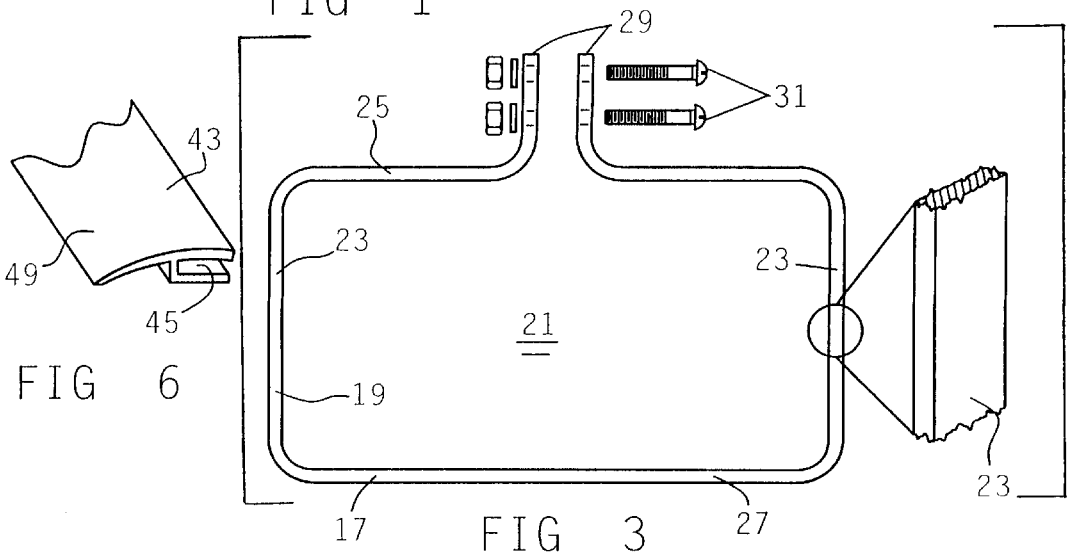
FIG 6
FIG 3

LOBBY DUST PAN

BACKGROUND OF THE INVENTION

1. Field of the Invention

This invention pertains to the field of hand-held cleaning appliances. More particularly, it pertains to a stand-up dust pan for use by persons walking about hotel and movie lobbies to remove spilled or dropped items before they can be walked into the carpet, and to a novel dust pan that can be used and emptied without the user soiling his or her hands.

2. Description of the Prior Art

There will always be the need to clean a rug or carpet. Especially where many people congregate, such as in the lobby of a movie or a hotel; accidents, such as inadvertently dropping food, paper, and the like, combined with the law of gravity, will always produce the same result, namely, something dropped on the floor to create a mess. Before the item is crushed into the carpet by other patrons, moving and milling about, the owner, manager, or other attendant hurriedly arrives with a "lobby" dust pan to sweep the item into the pan, often accompanied by a disapproving stare at the guilty patron, to remove the "offending" item.

Historically, the "lobby" dust pan has been a metal (stamped steel) pan, hingedly mounted at the sides to an upright, elongated member with a handle at the top, where the pan rotates upward into the vertical when not in use. When used, the rear wall of the pan is contacted with the carpet and the handle lowered to rotate the pan into full horizontal contact with the floor. A small broom is used to sweep the offending item into the low silhouette pan and the handle thereafter raised, to pitch the front of the pan upward thereby capturing the item in the pan. When taken to a remote area, the pan is again pitched downward and the item expelled into a trash container.

There are certain drawbacks to this device in its present form that do not make it popular with janitorial personnel and may be part of the reason these persons appear to have a dour attitude toward those who spill items on the floor. The biggest shortcoming is that the pan is made with a low silhouette to allow it to be hung on a wall without projecting into the room. However, this low silhouette makes it extremely difficult to remove gooey or sticky items from the pan, especially those that have fallen to the rear of the pan. One must reach into the pan and pry the sticky item out of its hiding place resulting in dirty fingers and hands and possible injury to finger nails.

Another drawback is that the low silhouette of the pan prevents one from lining the interior with any sort of throw-away bag or covering. Further, if the item is not removed, it may cause a noxious odor to permeate the air and offend the patrons gathered there. Even further, the pan requires constant cleaning to insure against a buildup of dirt and debris that causes undesirable odors. Usually, such a cleaning is not accompanied by a drying cycle so that water remains in the device and corrodes the pan and develop spots of rust particles that drop on the lobby carpet causing discoloration. This requires more cleaning or, more realistically, total replacement of the lobby carpeting, not to mention constant replacing of the dust pan, dust pan which means operating costs will suffer. Accordingly, there is a clear need for a "lobby" dust pan that is free of the disadvantages presently existing in the prior art.

SUMMARY OF THE INVENTION

This invention is a novel "lobby" dust pan that is free of the disadvantages previously discussed herein. It is easily folded and stored, with the same efficiency existing with present dust pans. Primarily, however, its unique design allows use of lightweight, throw-away plastic bags that may be merely pulled out of the dust pan after filling with debris and thrown into the trash. There is no longer a need to pry sticky items from the interior of the pan; no need to wash the gooey substances from the interior of the pan; and. no longer any source of offending odors or potential damage to one's hands and fingernails. Finally, the device is a lightweight unit made of non-corrosive aluminum and plastic that may be washed and air dried without fear of leaving rust spots or other discolorations.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE DRAWINGS

FIG. 1 is a side view of the preferred embodiment of the lobby dust pan of this invention;

FIG. 3 is a front view of the preferred embodiment of the frame component of this invention;

DESCRIPTION OF THE PREFERRED EMBODIMENT

Figure 2:
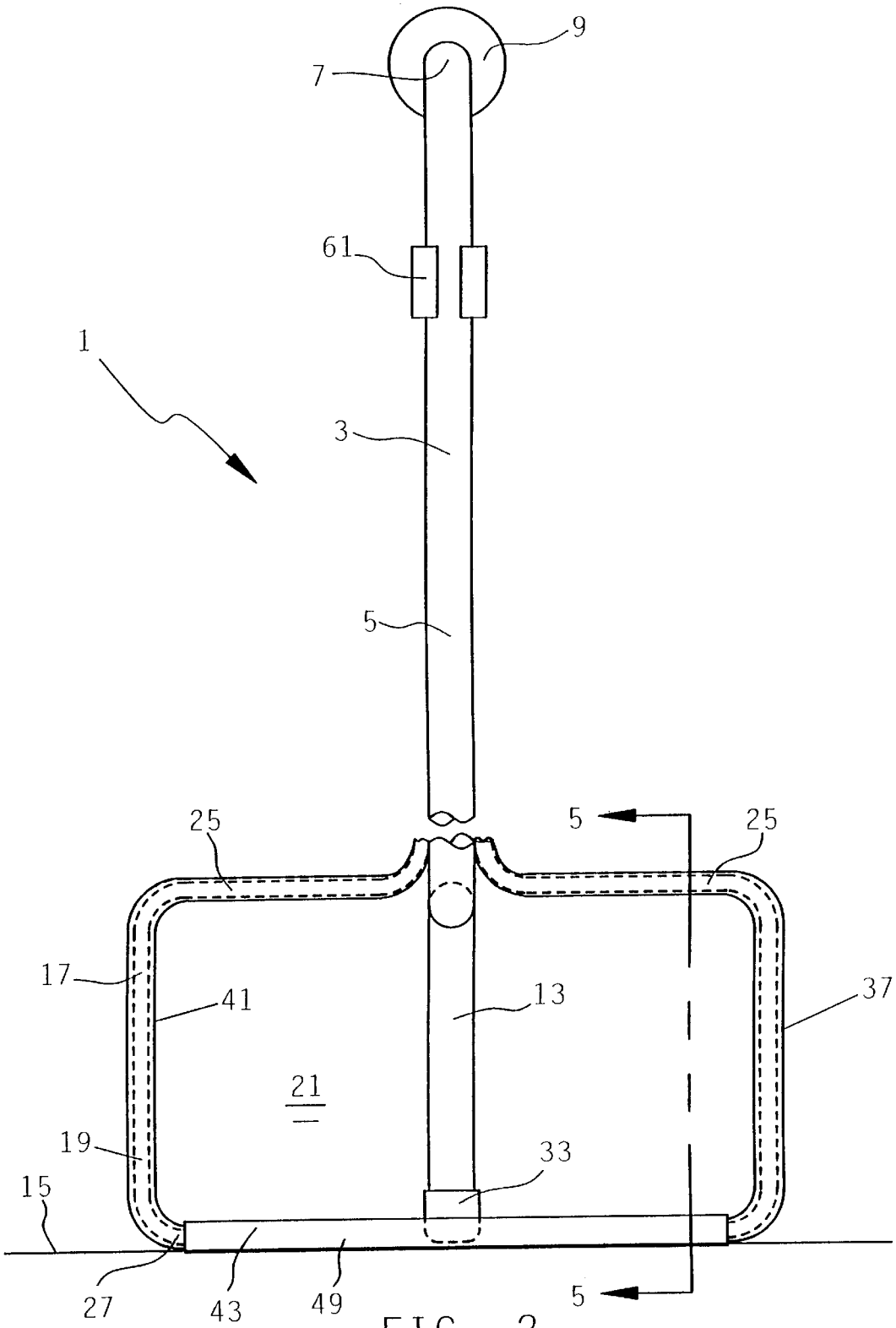
FIG. 2 is a front view of the embodiment shown in FIG. 1.

Turning now to the drawings, where elements are identified by numbers and like elements are identified with like numbers throughout the six figures, FIGS. 1 and 2 show the preferred embodiment of invention 1 in side and front views respectively. Invention 1 is shown to comprise a tube or other elongated member 3, preferably made of aluminum, having a first downwardly directed portion 5 for carrying by a handle 7 located thereabove, preferably covered with a rubber or plastic grip 9; a second portion 11, spaced-apart from handle 7, extending from the lower end of member 3 and bending away from first portion 5, preferably into the horizontal; and, a third portion 13 extending from second portion 11 and bending away from second portion 11 preferably into the vertical and terminating at floor level 15. Third portion 13 acts as a leg to help support dust pan 1 while second portion 11 acts as a connector between third portion 13 and first portion 5.

Figure 4:
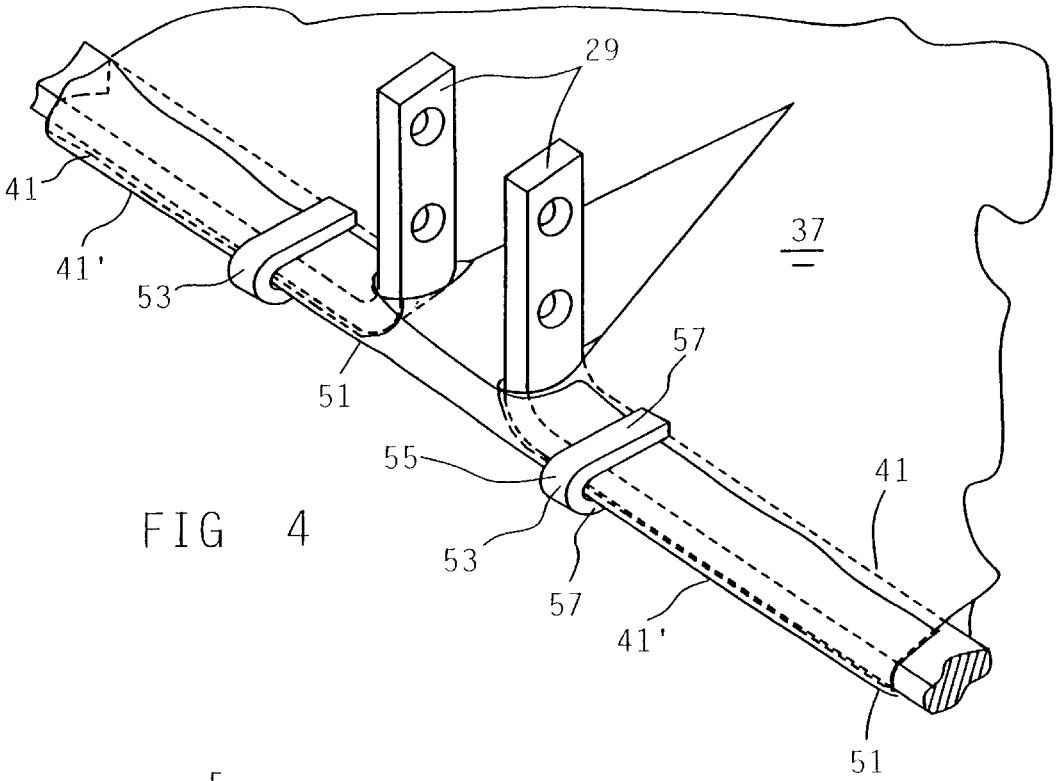
FIG. 4 is a close-up view of the manner in which the first bag is connected to the frame and in which a second, throw-away bag is clamped to the frame.

As shown in FIGS. 2, 3 and 4, a plane geometric structure or frame 17 is provided, having an enclosed perimeter 19, preferably in the form of a rectangular frame defining an opening 21 formed by an interconnected pair of spaced-apart frame sides 23, and spaced-apart longer frame top segment 25 and longer bottom segment 27. As shown in FIGS. 3 and 4, frame 17 is preferably formed of flat aluminum strap that terminates midway along top frame segment 25 in two bent-up frame attachment ends 29 that sandwich tube 3 therebetween and are bolted thereto using a pair of bolts passing through bores formed in tube 3, washers and nuts as generally indicated at 31. Third tube portion or leg 13 acts to support frame 17 in upright position on floor 15 with long frame bottom segment 27 parallel and adjacent floor 15. Preferably, a rubber cup 33 or other such protector is attached to the lower end of leg 13 to protect the floor from possible damage by the sharp end of the aluminum leg.

Figure 5:
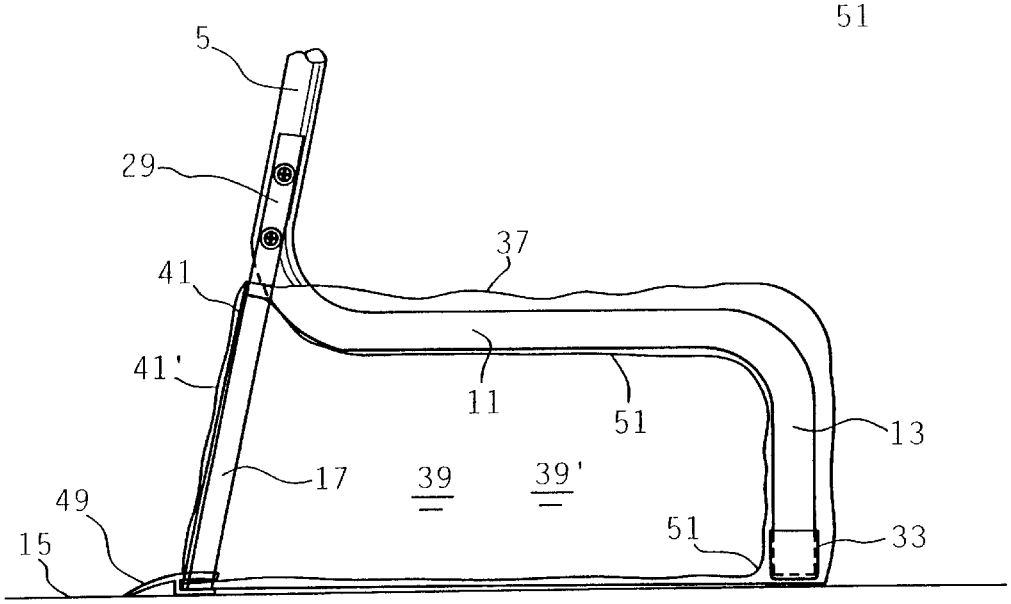
FIG. 5 is a sectional side view of a portion of the preferred embodiment taken along lines 5—5 in FIG. 2; and, FIG. 6 is a perspective view of the flange that is used along the bottom of the frame.

As shown in FIGS. 1, 2 and 5, a non-rigid container or first bag 37 is provided, having a flexible hollow body 39 and terminated about an opening 41, said opening 41 attached about frame 17 and body 39 extending rearward to encase second and third tube portions 11 and 13 respectively and body 39, for receipt of dust and debris swept from floor 15 in through frame opening 21. Note that in this preferred embodiment second tube portion or connector 11 provides interior support rearward for hollow body 39 while third tube portion or leg 13 provides interior support upward for hollow body 39 of first bag 37.

As shown in FIGS. 1, 5 and 6, a flange 43 is provided and positioned along bottom frame segment 27. Flange 43 contains a first portion 45 for clamping container 37 tightly over frame bottom segment 27 about its opening 41, and also includes a second portion forming a lip 49 passing from inside hollow body 39 to the outside thereof and adjacent floor 15. As shown in FIG. 6, such a flange 43 may be a plastic extrusion that is cut to length for positioning over a significant portion of frame bottom segment 27.

As shown in FIG. 4, first bag 37 may be conveniently mounted about frame 17 by looping the edge of bag 37 about its opening over frame sides and top and bottom segments 23, 25 and 27 respectively and turning it back upon itself and then sewing or otherwise anchoring the two pieces together.

As shown in FIGS. 4 and 5, first bag 37 is large enough and tall enough to accept a wide variety and volume of dust and debris and then may be conveniently cleaned without dirtying one's hands or clothes. To do so, a thin-walled, throw-away second bag 51 is provided (in quantity but used only one-at-a-time) of a size and shape similar to said flexible container or first bag 37 and has a similar-sized hollow body 39' and opening 41' therein. Second bag 51 is arranged for placement inside first bag 37 but this time bag 51 is interior of second tube portion or connector 11 and third tube portion or leg 13. In other words, connector 11 and leg 13 are retained between first bag 37 and second bag 51. As shown in FIG. 4, a first clamp 53 is provided and is preferably in the form of a U-shaped clip having a central bight area 55 and a pair of legs 57 extending outward parallel to said bight area 55 for passing over the top and bottom surface of the sides and top segment of frame 17 respectively to capture first bag 37 and second bag 51 therebetween and clamp them tightly against frame 17. When emptying dust pan 1, one merely removes clamps 53, lifts out second bag 51, discards it, and replaces it with a new bag 51. First bag 37 remains firmly attached about frame 17 and is supported interiorly by connector 11 and leg 13.

As shown in FIG. 1, a second clamp 61 is provided and has a first portion 63 for clamping to tube or elongated member 3 and a second portion 65 for clamping to a broom 67 that is normally supplied with a lobby dust pan.

To close dust pan 1 for storage, one merely removes the bolts and disconnects frame 17 from tube 3, twists frame 17 sideways, and flattens tube 3, frame 17 and first bag 37. This collapsed item may thereafter be hung up or stacked in storage.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A novel lobby dust pan for receipt of floor sweepings comprising:

a) a light weight tube having a first downwardly directed portion for carrying by a handle located thereabove, a second portion, spaced-apart from said handle, bending away from said first portion and a third portion blending away from said second portion and terminating at near floor level;

b) a frame, formed by interconnecting frame segments, located opposite said third tube portion, attached to said tube and defining an opening projecting forward and above floor level; and, c) a non-rigid container, having an opening attached about said frame and extending rearward to encase said second and said third tube portions therein, for receipt of dust and debris swept from the floor through said frame opening where said second and said third tube portions provide interior support for said container.

2. The novel lobby dust pan of claim 1 wherein said tube is a hollow aluminum tube.

3. The novel lobby dust pan of claim 1 further including a bend in said tube between said first downwardly directed portion and said handle so that said handle can be held in a horizontal position when using the dust pan.

4. The novel lobby dust pan of claim 3 further including a handle grip positioned over said handle.

5. The novel lobby dust pan of claim 1 further including a bend in said tube between said first downwardly directed portion of said handle so that said handle can be held in a horizontal position when using the dust pan wherein said second portion of said tube bent rearward thereof lies generally parallel and spaced-apart from said handle.

6. The novel lobby dust pan of claim 1 further including:

a) a bend in said tube between said first downwardly directed portion and said handle so that said handle can be held in a horizontal position when using the dust pan;

b) said second portion of said tube bent rearward of said first portion to lie generally parallel and spaced-apart from said handle; and, c) said third portion of said tube bent downward from said second portion to lie generally parallel to, and spaced apart from, said first tube portion.

7. The novel lobby dust pan of claim 1 wherein said frame is rectangular and defined by spaced-apart, long top and bottom segments and spaced-apart, short side segments, where said long bottom segment is arranged adjacent the floor and said frame is attached to said tube along its top segment.

8. The novel lobby dust pan of claim 7 further including a flange positioned along said bottom segment of said frame having a first portion for clamping over said bottom segment of said frame and a second portion forming a lip passing from inside said non-rigid container to the outside thereof and adjacent the floor.

9. The novel lobby dust pan of claim 1 wherein said non-rigid container opening is looped about said frame and anchored back onto itself.

10. The novel lobby dust pan of claim 1 further including a thin-walled, throw-away bag of a size and shape similar to said non-rigid container, and having a similar sized opening therein, said bag arranged for placement inside said non-rigid container, interior said second and third tube portions, and a first clamp for temporarily attaching said bag, about its opening, to said frame.

11. The novel lobby dust pan of claim 1 further including a second clamp for temporarily attaching a small broom to said tube.

12. A novel lobby dust pan for receipt of floor sweepings comprising:

a) a plane geometric structure, forming an enclosed perimeter about a central opening, arranged for upright positioning on a floor, and having a long bottom segment for placement adjacent the floor;

b) a leg, spaced-apart from said structure, arranged to support said structure in upright position on the floor and including a connector for attaching said leg to said structure;

c) a first bag, defined by a flexible container, for placement adjacent the floor and about said leg and said connector, and an opening therein, for mounting about said geometric structure;

d) a handle for carrying said structure and bag to various locations for sweeping debris from the floor through said opening in said structure;

e) an elongated member interconnecting said geometric structure and said handle in spaced-apart arrangement;

f) a small broom for use in sweeping trash into said first bag;

g) a first clamp to temporarily attach said small broom on said elongated member;

h) a second, thin-walled, disposable bag of a size and shape similar to said flexible container, and having a similar sized opening therein, said second bag arranged for placement inside said flexible container, interior said connector and said leg; and, i) a second clamp for temporarily attaching said second bag about its opening to said geometric structure.

13. The novel lobby dust pan of claim 12 wherein said structure, leg and handle are light-weight aluminum.

14. The novel lobby dust pan of claim 12 further including a handle grip positioned over said handle.

15. The novel lobby dust pan of claim 12 further including a bend in said elongated member, between said geometric structure and said handle, so that said handle can be held in a horizontal position when using the dust pan.

16. The novel lobby dust pan of claim 12 further including a bend in said elongated member between said geometric structure and said handle so that said handle can be held in a horizontal position when using the dust pan, wherein said connector is attached to said elongated member and arranged generally parallel and spaced-apart from said handle; and, wherein said leg is attached to said connector to angle downward and spaced-apart from said elongated member.

17. The novel lobby dust pan of claim 12 wherein said geometric structure is rectangular and defined by interconnected, spaced-apart, long top and bottom segments and spaced apart, short sides, wherein said long bottom segment is arranged adjacent the floor, and wherein said geometric structure is attached to said elongated member along its top segment.

18. The novel lobby dust pan of claim 17 further including a flange positioned along said long bottom segment of said geometric structure having a first portion for clamping said first bag tightly over said bottom segment of said geometric structure and a second portion forming a lip passing from inside said first bag to the outside thereof and adjacent the floor.

* * * * *

UNITED STATES PATENT AND TRADEMARK OFFICE

CERTIFICATE OF CORRECTION

PATENT NO. : 6,052,860
DATED : April 25, 2000
INVENTOR(S) : Joe Bryant Coxsey

It is certified that error appears in the above-identified patent and that said Letters Patent is hereby corrected as shown below:

In column 4, line 11, the word "blending" should read—bending--.

Signed and Sealed this

Sixth Day of March, 2001

Nicholas P. Godici

*Attest:*

NICHOLAS P. GODICI

*Attesting Officer*

*Acting Director of the United States Patent and Trademark Office*